US005566219A

United States Patent [19]

Vogler

[11] Patent Number: 5,566,219

[45] Date of Patent: Oct. 15, 1996

[54] X-RAY APPARATUS COMPRISING OF A CIRCUIT ARRANGEMENT FOR ACCELERATING AND DECELERATING THE ROTARY ANOBE OF A ROTARY-ANODE X-RAY TUBE

[75] Inventor: Gerd Vogler, Minden, Germany

[73] Assignee: U.S. Philips Corporation, New York, N.Y.

[21] Appl. No.: 389,378

[22] Filed: Feb. 16, 1995

[30] Foreign Application Priority Data

Feb. 23, 1994 [DE] Germany ..... 44 05 767.9

[51] Int. Cl.[6] ..... H05G 1/66

[52] U.S. Cl. ..... 378/93; 378/94; 318/108; 318/442

[58] Field of Search ..... 318/106, 107, 318/108, 109, 262, 259, 274, 441, 442; 378/93, 94

[56] References Cited

U.S. PATENT DOCUMENTS 3,963,930 6/1976 Fiocca et al. ..... 250/402

5,090,041 2/1992 Furbee ..... 378/93

*Primary Examiner*—Don Wong

*Attorney, Agent, or Firm*—Jack D. Slobod

[57] ABSTRACT

The invention relates to an X-ray apparatus, comprising a circuit arrangement for accelerating and decelerating the rotary anode of a rotary-anode X-ray tube in which phase-shifted alternating voltages can be applied to the stator windings of the drive motor for the rotary anode in an acceleration mode and a direct voltage acts on at least one of the windings in a deceleration mode, and also comprising a control device for the acceleration mode and the deceleration mode. A particularly simple construction is achieved in that at least one of the stator windings is connected to a voltage source which supplies a periodic alternating voltage in a first operational state and a pulsating direct voltage in a second operational state, that a diode arrangement which can be switched on and off is connected in parallel with this stator winding with a polarity such that it is operated in the reverse direction by the pulsating direct voltage source and that in the acceleration mode the control device keeps the alternating voltage source in the first operational state and switches off the diode whereas in the deceleration mode it keeps the alternating voltage source in the second state and switches on the diode arrangement.

5 Claims, 1 Drawing Sheet

X-RAY APPARATUS COMPRISING OF A CIRCUIT ARRANGEMENT FOR ACCELERATING AND DECELERATING THE ROTARY ANOBE OF A ROTARY-ANODE X-RAY TUBE

The invention relates to an X-ray apparatus, comprising a circuit arrangement for accelerating and decelerating the rotary anode of a rotary-anode X-ray tube having a driving motor in which phase-shifted alternating voltages can be applied to the stator windings in an acceleration mode and a direct voltage acts on at least one of the windings in a deceleration mode, and also comprising a control device for the acceleration mode and the deceleration mode.

An X-ray apparatus of this kind is known from U.S. Pat. No. 3,963,930. Therein, the stator windings can be connected at option, via a series of switches, to an alternating voltage source for a low speed, to an alternating voltage source for a high speed, and to a direct voltage source. The switches are controlled by a control device in such a manner that one of the two alternating voltage sources is connected to the stator windings in the acceleration mode and the direct voltage source is connected thereto in the deceleration mode. The multitude of switches required for this purpose and the fact that separate voltage sources are required for the high speed mode and the deceleration mode make this circuit X-ray apparatus complex.

It is an object of the present invention to provide a simple X-ray apparatus of the kind set forth. This object is achieved in accordance with the invention in that at least one of the stator windings is connected to a voltage source which supplies a periodic alternating voltage in a first operational state and a pulsating direct voltage in a second operational state, that parallel to the relevant stator winding there is connected a diode arrangement which can be switched on and off and which has a polarity such that it is operated in the reverse direction by the pulsating direct voltage source, that in the acceleration mode the control device keeps the alternating voltage source in the first operational state and switches off the diode device, and that the control device keeps the alternating voltage source in the second state and switches on the diode arrangement in the deceleration mode. The voltage source feeding said one stator winding is active in the acceleration as well as in the deceleration mode. The diode arrangement, being active only in the deceleration mode and consisting of a diode in the simplest case, ensures that the power loss in the deceleration mode remains small, thus preventing damaging of the components.

In a preferred embodiment of the invention, the alternating voltage source comprises two switching members, each of which comprises a respective switch, the switches being connected to a direct voltage source and in the first operational state being periodically switched, and in the second operational state one switching member being blocked whereas the other switching member is periodically switched on and off. The switching members apply the direct voltage with opposite polarity to the one stator winding in an alternating fashion and, as a result of the blocking of the one switching member, the pulsating direct voltage required for the deceleration mode can be readily produced. At least one of the switching members has a dual function, i.e. it operates in the acceleration mode and in the deceleration mode, resulting in a further reduction of components.

The two switching members connected to the direct voltage source supplying the direct voltage, act as a dc-ac convertor and it will be evident that, in the case of a drive motor comprising two stator windings for the other stator winding a further dc-ac convertor could be formed by means of two further switching members but the same direct voltage source, the output voltage of said further convertor being shifted 90° relative to that of the first convertor. The advantage over drives in which the phase of the alternating voltage for the one stator winding is shifted by means of an auxiliary capacitor would then reside in the fact that two voltages rigidly shifted through an angle of 90° could be generated with the same power. The same advantage, but also a further simplification, is achieved in a further embodiment of the invention in which there is provided a rectifier arrangement whose direct voltage output is connected to the first stator winding, via the switching members, and whose alternating voltage input is connected to the second stator winding. Switching members for a second inverter and the associated control can thus be dispensed with therein.

In a further embodiment there are provided means for generating a control signal shifted 90° relative to the voltage on the second stator winding, and also means for deriving the switching signals for the switching members from the control signal. Notably the establishment of the 90° phase relationship between the voltages on the stator windings is thus simplified.

In a further embodiment of the invention there is provided a square-wave voltage source (33, 34) which generates a square-wave signal with an adjustable duty cycle for controlling the one switching member (21) in the deceleration mode. The intensity of the deceleration can thus be influenced.

The invention will be described in detail hereinafter with reference to the drawing. Therein:

Figure 1:
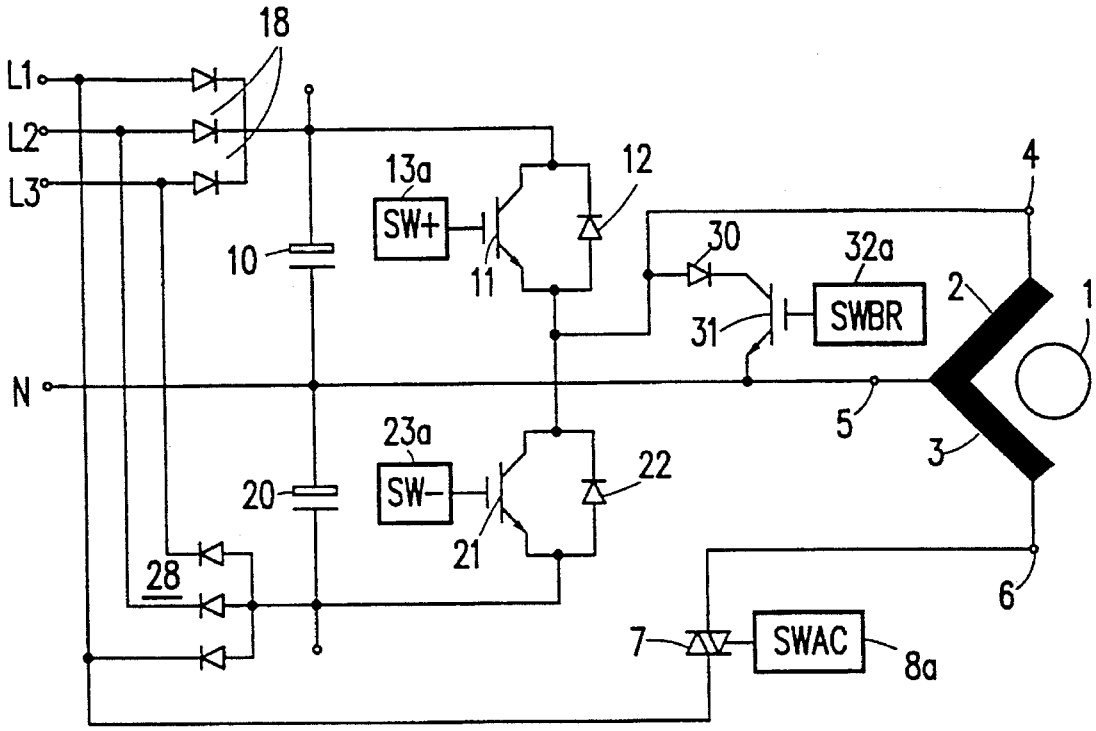
FIG. 1 shows the X-ray apparatus in accordance with the invention.

The reference numeral 1 in FIG. 1 denotes the rotor of a drive motor which supports the rotary anode of a rotary-anode X-ray tube, and the reference numerals 2 and 3 denote the associated stator windings which have been shifted through 90° relative to one another. The rotor is a short-circuit rotor and the drive motor is an asynchronous motor. A comparatively large clearance exists between the stator windings 2, 3 and the rotor, because the cathode carries high-voltage potential during operation of the X-ray tube and the stator carries ground potential. Consequently, a weak magnetic coupling exists between the rotor 1 and the stator 2, 3. The remainder of the rotary-anode X-ray tube is not shown.

The electric power for acceleration and deceleration is derived from the terminals L1, L2, L3 of a three-phase mains, which terminals carry three alternating voltage of mains frequency which have been shifted 120° relative to one another with respect to their common zero point N. From the three alternating voltages a positive direct voltage is formed across a capacitor 10 via respective rectifier diodes 18; likewise, from the three alternating voltages via oppositely poled rectifier diodes 28, a negative direct voltage is also formed across a capacitor 20. The two capacitors 10 and 20 are connected in series and to the zero point N of the three-phase mains by way of their common junction, said zero point also being connected to the common junction 5 of the two stator windings 2 and 3.

The terminals of the capacitors 10 and 20 which are remote from the common junction are interconnected via controllable switches in the form of IGBT transistors 11, 21. The common junction of the two transistors is connected to the second terminal 4 of the stator winding 2. Antiparallel with the IGBT transistors 11 and 21 there is connected a respective diode 12, 22. These diodes, therefore, normally are not conductive unless the voltage on the terminal 4 is more positive than the voltage across the capacitor 10 or more negative than the voltage across the capacitor 20.

The elements 10 . . . 12, 20 . . . 22 constitute an ac-dc convertor in a half-bridge arrangement. Instead, use could in principle also be made of a converter in a full-bridge arrangement in which the stator winding 2 is connected, via two switching members comprising two switches each, to a direct voltage source as is known from U.S. Pat. No. 3,832,553. However, the complexity would then be greater, even though one of the rectifier groups 18 or 28 and the associated capacitor 10 or 20 could be dispensed with. During the acceleration of the rotary anode, the switches 11 and 21 are switched on and off in push-pull fashion, so that a square-wave alternating voltage (without direct voltage component) occurs on the stator winding 2.

Moreover, the series connection of a diode 30 and an IGBT transistor switch 31 is connected parallel to the stator winding 2. This transistor switch is conductive (closed) only during the deceleration phase. The terminal 6 of the second winding 3 is connected to the alternating voltage terminal L1 via a (triac) switch 7.

Figure 2:
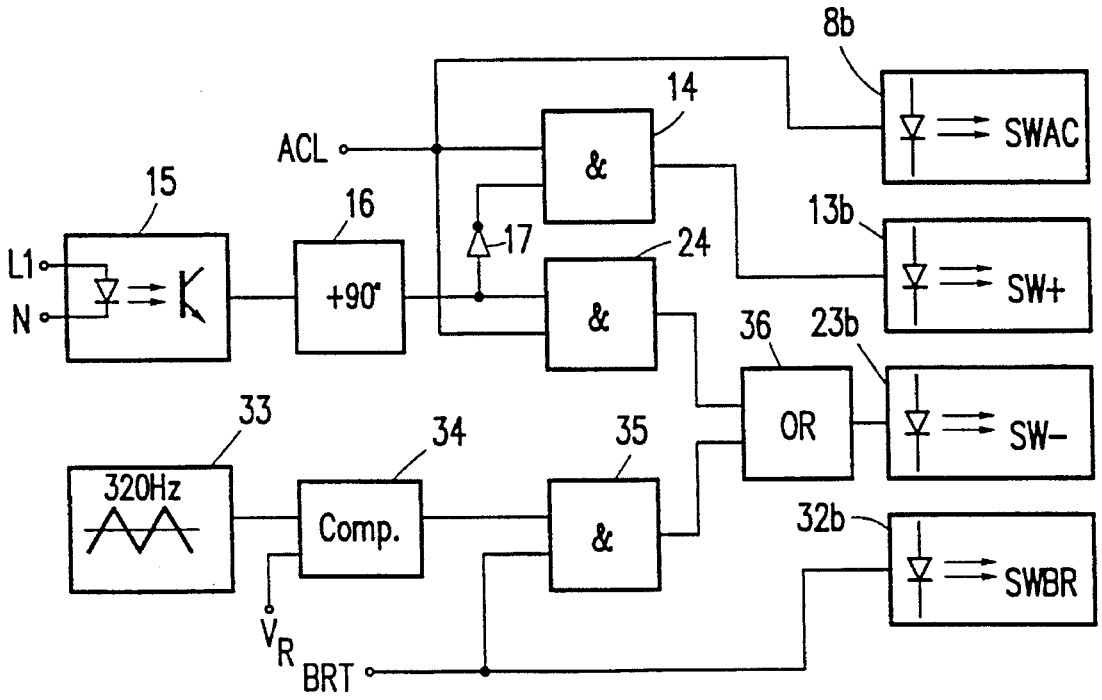
FIG. 2 shows the associated control device.

The switches 7, 11, 21 and 31 are switched via optocouplers, one pan of which (i.e. the receiving pan 8*a*, 13*a*, 23*a*, 32*a*) is shown in FIG. 1, its other pan (the transmitter pan 8*b*, 13*b*, 23*b* and 32*b*) being shown in FIG. 2 in conjunction with the control device. The control device supplies the switching signals required for controlling the four said switches.

From the voltage present between the terminals L1 and N, also present on the stator winding 3, in the circuit 15 a signal is formed which has the same phase as and is synchronous with this voltage and which is applied to a 90° phase shifter 16, preferably an integrator, whose output signal is shifted 90° relative to its input signal. The output signal of the phase shifter 16 is applied to the first input of an AND-gate 24 and, via an inverter 17, to the first input of an AND-gate 14. The second inputs of these AND-gates are connected to a control input ACL which is also connected to the optocoupler 8*b*/8*a* for controlling the switch 7. The output of the AND-gate 14 is connected to the optocoupler 13*b/a* for controlling the IGBT transistor 11, whereas the AND-gate 24 is connected to one input of an OR-gate 36 whose output is connected to the optocoupler 23*b/a* which supplies the switching signals for the IGBT switching transistor 21.

The control device also comprises a generator 33 which generates a triangular-shaped alternating voltage of, for example 320 Hz. In a comparator 34 this alternating voltage is compared with an adjustable direct voltage $V_R$, so that a 320 Hz square-wave signal appears on the output of the comparator, the duty cycle of said square-wave signal being dependent on the polarity of the direct voltage $V_R$ as well as on the magnitude thereof in relation to the delta-shaped signal of the generator 33. The output signal of the comparator 34 is applied to one input of an AND-gate 35, the output of which is connected to the second input of the OR gate 36. The second input of the AND-gate 35 is connected to a control input BRT which at the same time controls the IGBT switch 31 via the optocoupler 32*b*/32*a*.

The operation of the circuit is as follows:

When the operator wishes to execute an X-ray exposure, the rotor 1 must be accelerated to its nominal speed from standstill. To this end, the signal on the control input ACL is set to "1" for a defined period of time, for example one second, whereas the control signal on the control input BRT remains "0". Consequently, during this period of time the AND-gates 14 and 24 supply square-wave signals of opposite phase which switch the IGBT switches 11 and 21 on and off in a push-pull fashion, via the optocouplers 13*a/b* and 23*a/b*, respectively, so that a square-wave voltage of mains frequency occurs across the stator winding 2, said square-wave voltage being phase shifted 90° with respect to the mains voltage between L1 and N. During said period of time the optocoupler 8*b/a* also turns on the switch 7, so that a sinusoidal alternating voltage is present across the stator winding 3. It would in principle also be possible to feed the stator winding 3 with a square-wave voltage by means of a second inverter. However, further IGBT switches and optocouplers would then be required, so that the complexity of the circuity would be increased.

Because the direct voltage across the capacitors 10 and 20 always corresponds to the amplitude of the alternating voltage, the square-wave voltage on the stator winding 2 has the same amplitude as the sinusoidal alternating voltage on the stator winding 3. Because the amplitude of the sinusoidal fundamental oscillation in a square-wave voltage is approximately 27% higher than that of the square-wave voltage, in the case of identically constructed stator windings the current through the stator winding 2 is proportionally larger than the current through the stator winding 3. This asymmetry per se is not disturbing; if necessary, it can be eliminated by imparting a correspondingly larger number of turns to the stator winding 2.

After termination of the acceleration period, the signal ACL also becomes "0". The rotary anode has then reached its desired speed and, because of its moment of inertia, it continues to rotate during the subsequent X-ray exposure. All switches are blocked.

After completion of the X-ray exposure, the rotary anode is decelerated in order to save its bearings. A rotary anode could in principle be decelerated by means of a so-called rotary field brake which, however, would require not only a multi-phase inverter but also measurement or simulation of the instantaneous number of revolutions, because without knowledge thereof standstill of the rotary anode cannot be achieved. Because of the weak magnetic coupling between rotor and stator, generated breaking, in which the energy stored in the rotor is fed back to a braking resistor via a rectifier, will have no effect. A practical alternative remaining is the deceleration of the rotor by way of a direct voltage derived from the mains.

If one of the direct voltages across the capacitors 10 or 20 were used directly for this purpose by connecting the terminal 4 to one of these voltages during the deceleration phase, via one of the switches 11, 21, such a strong deceleration moment would occur that the rotary-anode shaft could be damaged or, in the case of magnetic saturation of the stator stack, at least very high heat dissipation would occur in the stator winding. However, direct current deceleration could also be achieved by alternately switching on the two switches 11, 21 during the deceleration, be it with a different duty cycle, so that on the terminal 4 there would arise a pulsed alternating voltage on which a DC component is superposed. This solution, however, would have the drawback that at the high rate at which the switches 1 I, 21 should be switched, because of the stator inductance only that switch 11, 21 which is switched on for a longer period would carry a current (for example the switch 21 ). After reactivation of this switch, the current of the stator winding would flow via the diode (12) connected in antiparallel with the other switch, so that it would overload and destroy the associated capacitor (10). In order to prevent this, an additional depletion resistor must be inserted, which, however, would convert a high power loss into heat.

Therefore, the invention follows a different approach. For the purpose of deceleration, the signal on the control input BRT is adjusted to "1" and that on ACL to "0" for a fixed period of time which suffices for complete deceleration, for example 1 second. As a result, via the optocoupler 32*a*, 32*b* the switch 31 is rendered conductive, so that the diode 30 acts in parallel with the stator winding 2. The switch 7 is blocked because it is not activated via the optocoupler 8*a/b*. The switch 11 is also blocked, because the AND gate 14 does not transmit switching pulses to the optocoupler 13*a/b*. However, square-wave pulses of adjustable duty cycle reach the optocoupler 23*a/b*, via the AND-gate 35 and the OR-gate 36, and periodically switch the switch 21 on and off.

Consequently, on the terminal 4 a pulsating direct voltage is generated, i.e. a (square-wave) alternating voltage with a superposed DC component. As a result, a direct current with a given ripple flows in the stator winding 2, which current produces a magnetic field which decelerates the rotor 1. If the diode 30 were not active parallel to the stator winding 2, the current would flow via the diode 12 during the pulse intervals, i.e. in the blocked state of the switch 21, so that further charging of the capacitor 10 would occur or an additional electric power of the order of magnitude of the deceleration power required for decelerating the rotor would be required. This loss of power is almost completely avoided in that the stator winding 2 is short-circuited by the diode 30 during the pulse intervals, because the current need no longer overcome the countervoltage across the capacitor 10. This also results in less ripple of the current through the stator winding; this can be used to reduce the switching frequency. The switching voltage swing is halved at the same time. These two effects reduce the losses in the switch 21 substantially. At the end of the period, during which BTL="1", the rotor 1 has been completely decelerated. The deceleration force can be adapted to the relevant requirements by variation of the reference voltage $V_R$ at the comparator 34.

The circuit arrangement can also be connected to a single-phase alternating current mains instead of to a three-phase mains; in that case the alternating voltage must be applied to the terminal L1. Additional capacitors should then be connected in parallel to the capacitors 10, 20 in order to keep the ripple of the direct voltage small.

I claim:

1. An X-ray apparatus, comprising a circuit arrangement for accelerating to an operating speed and decelerating to a zero speed the rotary anode of a rotary-anode X-ray tube having a drive motor in which phase-shifted alternating voltages are applied to stator windings in an acceleration mode and a direct voltage acts on a stator winding among said stator windings in a deceleration mode, and also comprising a control device for the acceleration mode and the deceleration mode, characterized in that said stator winding is connected to an alternating voltage source having first and second operational states controlled by the control device, the alternating voltage source supplying a periodic alternating voltage to said stator winding in the first operational state of the alternating voltage source and supplying instead a pulsating direct voltage to said stator winding in the second operational state of the alternating voltage source, that in parallel to said stator winding there is connected a diode arrangement which can be enabled and disabled by the control device and which has a polarity such that the diode arrangement is reverse biased by the pulsating direct voltage of the alternating voltage source when the alternating voltage source is in the second operational state, that in the acceleration mode the control device keeps the alternating voltage source in the first operational state and disables the diode arrangement, and that in the deceleration mode the control device instead keeps the alternating voltage source in the second operational state and enables the diode arrangement.

2. An X-ray apparatus as claimed in claim 1, characterized in that the alternating voltage source comprises first and second switching members, each of which comprises at least one switch, the switching members being connected to a direct voltage and in the first operational state being periodically switched and in the second operational state, the first switching member being blocked whereas the second switching member is periodically switched on and off.

3. An X-ray apparatus as claimed in claim 2, characterized in that the drive motor comprises first and second stator windings, there being provided a rectifier arrangement whose direct voltage output is connected to the first stator winding, via the switching members, and whose alternating voltage input is connected to the second stator winding.

4. An X-ray apparatus as claimed in claim 3, characterized in that there are provided means for generating a control signal shifted 90° relative to the voltage on the second stator winding, and also means for deriving the switching signals for the switching members from the control signal.

5. An X-ray apparatus as claimed in claim 2, characterized in that there is provided a square-wave voltage source which generates a square-wave signal with an adjustable duty cycle for controlling the second switching member in the deceleration mode.

* * * * *